United States Patent [19]

Goldberg

[11] 4,453,629

[45] Jun. 12, 1984

[54] MASK DISPLAY PACKAGE

[76] Inventor: Mel Goldberg, c/o Topstone Industries, Inc., 2 Augusta Dr., Danbury, Conn. 06810

[21] Appl. No.: 450,725

[22] Filed: Dec. 17, 1982

[51] Int. Cl.[3] ..... B65D 65/16

[52] U.S. Cl. ..... 206/45.33; 206/445; 206/457; 206/461; 206/471; 206/504; 206/508; 206/509

[58] Field of Search ..... 206/471, 461, 45.33, 206/445, 449, 457, 504, 508, 509

[56] References Cited

U.S. PATENT DOCUMENTS

| | | | |
|---|---|---|---|
| 3,463,309 | 8/1969 | Szostek | 206/470 |
| 4,106,614 | 8/1978 | Aylott | 206/471 |
| 4,146,128 | 3/1979 | Hogg et al. | 206/470 |

FOREIGN PATENT DOCUMENTS

| | | | |
|---|---|---|---|
| 1353019 | 1/1964 | France | 206/461 |

*Primary Examiner*—Joseph M. Moy

*Attorney, Agent, or Firm*—Mandeville and Schweitzer

[57] ABSTRACT

A display package for face masks is provided. The package presents the mask in a realistic, three-dimensional form. The package is nestable with other packages. In addition, the package preserves the relative hygienity of the face mask, until purchase, and yet, allows potential purchasers to try-on the mask by placing the package and mask over the potential purchaser's face prior to purchase. The transparent package basically comprises a front and rear section, each having forwardly projecting, mask shaped areas. The face mask is held between the mask shaped areas.

3 Claims, 3 Drawing Figures

MASK DISPLAY PACKAGE

BACKGROUND OF THE INVENTION

The present invention relates to a display package for use in connection with the shipment and display of face masks. More specifically, the present invention relates to a mask display package which is intended to be used in connection with the shipping and actual sale of conventional face masks and especially for an over-the-head face mask, which itself is frequently provided with artificial hair. These types of face masks are purchased by adults and children, in connection with costume parties, Halloween, and even for fun, novelty and practical jokes. The present invention is directed toward a sanitary display package for such a face mask which is intended to protect and contain the face mask during shipment and, in addition, it is also intended to be used for display of the item at the ultimate point of sale of the mask in a retail establishment.

DESCRIPTION OF THE PRIOR ART

The conventional manner of packaging facial masks for shipment and display basically takes three forms, i.e., in flat transparent envelopes, separately in cardboard boxes and many loose masks in a single carton. The flat envelope type manner of shipping utilizes transparent, flat envelopes, into which a face mask is inserted and sealed. The masks individually packaged in cartons generally have either a picture on the front of the carton of the face mask or a transparent window area to enable the potential purchaser to actually view the mask contained therein.

While the flat plastic envelope provides a relative hygienic manner of sale of the face mask, the mask contained therein is not displayed in a realistic manner, since it is, of necessity, folded or crushed flat prior to insertion and sealing within the envelope. In addition, the clear envelopes do not afford potential purchasers the ability to try on the face mask prior to purchase. Further, the envelopes are frequently stacked on shelves and cannot, therefore, be of any significant use in attracting potential customers in the retail stores. It has been recognized that a large percentage of purchasers of these type face masks do so on impulse buying, which requires that the display device catch the potential purchaser's attention while in the store. The more realistically the face mask is presented for display, the better the chances for a sale by the retail establishment. Finally, the flat, clear envelopes, when stored on shelves, are relatively difficult to maintain in a visually pleasing manner and, frequently, slide over one another and fall onto the floor. The present invention is intended to provide a display package which preserves hygienity, neatness and order, yet, at the same time, displays the mask in a realistic manner.

The cardboard cartons which are now used for the purpose of selling face masks are relatively easy to stack and maintain in a neat fashion but, however, themselves suffer from several disadvantages. More specifically, while the cartons may be selectively opened by potential customers for the purpose of enabling them to try on, before buying, the masks contained therein, they do so in a non-hygienic manner. Thus, the actual purchaser of a face mask contained within such a carton may purchase a face mask which is not germ-free since the possibility exists that a plurality of other potential buyers may have previously tried on the mask. If the carton, however, is sealed for shipment and display, thereby preserving a sanitary condition, then the carton suffers from the disadvantage of precluding a potential customer from first trying on the face mask prior to purchase. In addition, similar to the disadvantage of the flat, clear envelopes used in the transportation and sale of facial masks, the cartons do not present the face masks at display in a realistic manner, i.e., in a three-dimensional form. The individual cartons used in connection with the transportation and sale of face masks, while easy to ship in a neat manner and displayed, waste a tremendous volume of space since the mask product itself is very thin when compared to the cardboard shipping container.

It is also conventional, in connection with the transportation, storage and sale of masks, for them to be merely contained, in bulk, in a single carton. This, however, suffers from many disadvantages, among them being loss of relative hygienity, i.e., exposure to germs during prepurchasing trying on of the masks; the relative failure to attract impulse buyers; the failure to display the masks in a realistic three-dimensional manner, and the appearance of "on-sale" or second rate merchandise.

It is an object of the present invention to provide a shipping and display container for face masks which is efficient for shipping and display, with respect to volume, presents the ultimate purchaser with a substantially germ-free mask, presents the face mask in a realistic, three-dimensional manner for display and sale and, in addition, allows potential purchasers the opportunity to first visually try-on the face mask, albeit still contained in the package, prior to purchase.

SUMMARY OF THE INVENTION

The present invention relates to a mask display package which is intended to be used in connection with the retail sale of facial masks. Typically, these facial masks are of rubber composition and are intended to be worn over the head of a purchaser; for example, at costume parties or at Halloween. The mask display package of the present invention basically comprises a transparent front section and a rear section, which when assembled together provide a three-dimensional mask shaped, holding pocket and a peripherally located three-dimensional hair-holding pocket. The face of the mask is maintained in the three-dimensional mask holding pocket, while the artifical hair of the face mask is maintained in the hair holding pocket. In this manner, the face mask is displayed in an extremely realistic manner, i.e., it is presented in three-dimensional form and, in addition, the actual coloration of the face mask showing through the transparency of the mask display package is presented.

The front section and the rear section of the mask display package of the present invention is, in the preferred embodiment, made from a transparent plastic material frequently used in blister packaging. The front section and the rear section are provided with central mask shaped areas, whose three-dimensional shape substantially corresponds to the shape of the face portion of the mask which the package is intended to contain. Surrounding the central three-dimensional mask shaped areas of both the front and rear sections of the package is a flat yet three-dimensional, hair holding pocket for the artificial hair of the mask.

When the present invention is assembled, with a face mask packaged between the mask conforming areas of the front section and the rear section, the face mask projects into the mask shaped area of the front section and is pressed therein by the three-dimensional mask conforming area of the rear section. Thus, the mask is presented in three-dimensional realistic form.

In addition, since the rear section of the mask display package has a forwardly projecting three-dimensional shape which substantially corresponds to the forwardly projecting three-dimensional shape of the front section, a second mask display package of corresponding shape will be nestingly received by a first mask display package. That is to say, the forwardly projecting mask shaped area of the front section of a second mask display package will be matingly received within the forwardly projecting mask shaped area of the rear section of a first mask display package located in front of the second mask display package. In this manner, an extremely efficient, in terms of volume of space, shipping, storing and display package is provided.

As previously mentioned, the clear transparency of the display package and the three-dimensionality of the mask shaped area of the two sections present an extremely realistic display of the mask for its sale and presentation. In addition, as also mentioned, the mask display package, due to its nesting ability, is extremely efficient in a space-occupying manner, both for display purposes and for shipping from the manufacturer to the retailer. Furthermore, the display package of the present invention preserves the face mask contained therein in a relatively hygienic manner, i.e., the purchaser of a mask display package containing a face mask will feel confident that the mask has not been tried on by a plurality of others prior to his purchase. This is accomplished because of the face mask being contained within the mask holding pocket of the package which is substantially contaminant-free until after actual purchase.

The three-dimensionality of the mask display package and the fact that the front section and the rear section substantially conform to the shape of the mask contained therein enable potential purchasers of the mask to first try on the mask. This, according to the invention, is accomplished by placing the three-dimensional cavity, formed by the three-dimensional central mask shaped area of the rear section of the package, over the front of the potential purchaser's face. In this manner, the potential purchaser can see how the mask looks on his head or have others see him with the mask on, with the mask being held basically flush against the wearer's face. This is accomplished without, however, unnecessarily contaminating or exposing the mask to germs such that, in the event that that particular potential purchaser does not actually buy the face mask, the mask has not been exposed to germs.

In addition, the present invention provides a protective outer surface for the facial mask contained within the mask display package to thereby prevent accidental marring or damage to the face mask prior to sale.

DETAILED DESCRIPTION OF THE PREFERRED EMBODIMENT

Figure 1:
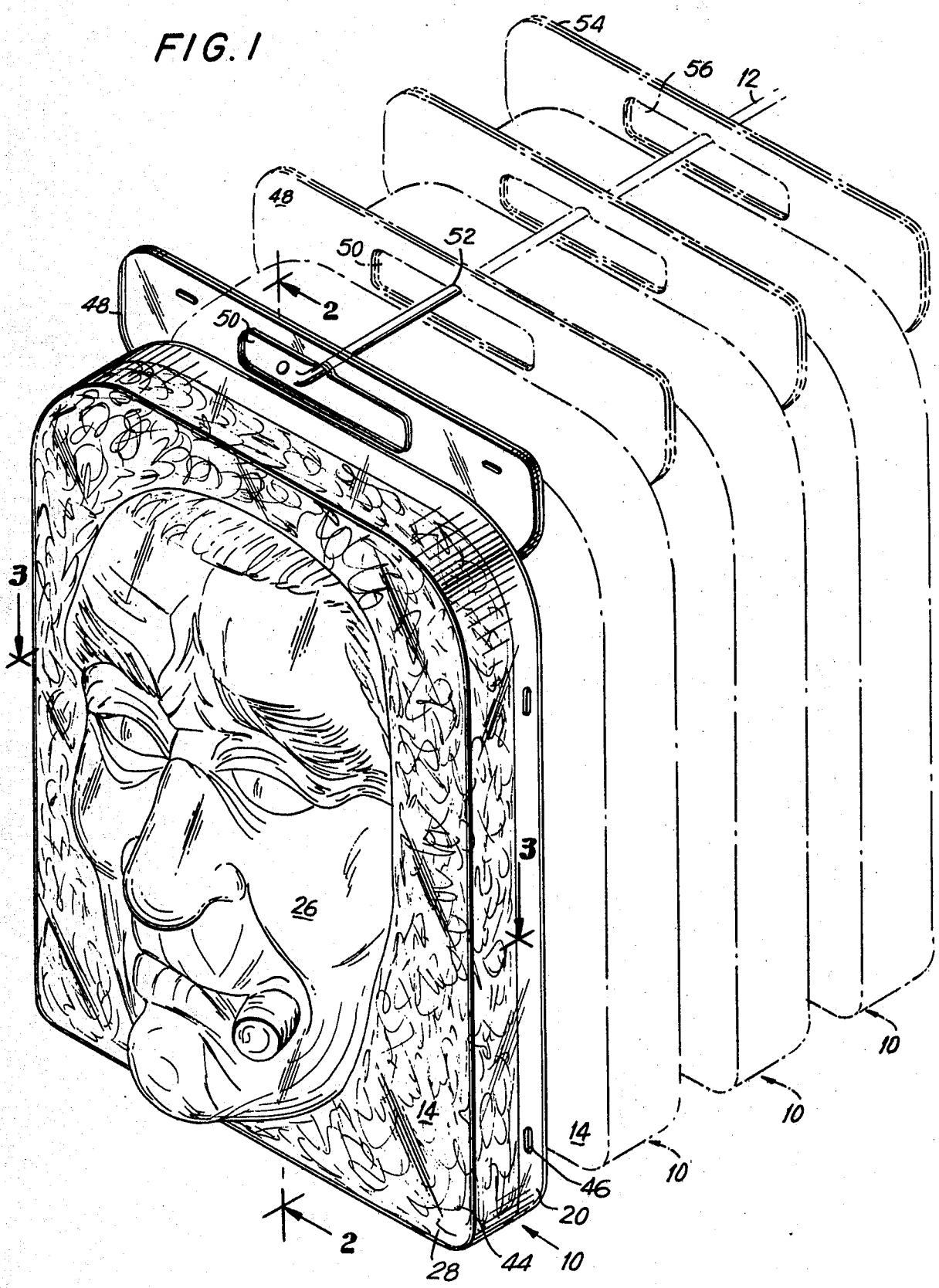
FIG. 1 is a perspective view of several mask display packages of the present invention, containing over-the-head type face masks and showing the packages nested for display on a display hook (partially shown)

As best seen in FIG. 1, a plurality of mask display packages 10 are supported for display and sale on a display hook 12, at the point of sale in a retail establishment. The display hook 12 is, of course, secured to a vertical pegboard in a conventional fashion and forms no part of the present invention. It can be seen, however, that the present invention enables many mask display packages 10 to be neatly and conveniently nested on a single display hook 12 and, therefore, is extremely economical in terms of the volume of space used and, yet, is nevertheless, aesthetically pleasing in terms of satisfying the desired display function. In addition to the above, the package presents the mask in an extremely realistic manner and also provides a hygienic or sanitary package for the mask. The mask package is preferably made from a clear, i.e., visually transparent plastic which is conventional in blister type packaging. Thus, the mask is displayed in a realistic fashion, both with respect to the mask having a three-dimensional display appearance and, in addition, the actual coloration of the mask is fully visible through the clear plastic of the package.

Figure 2:
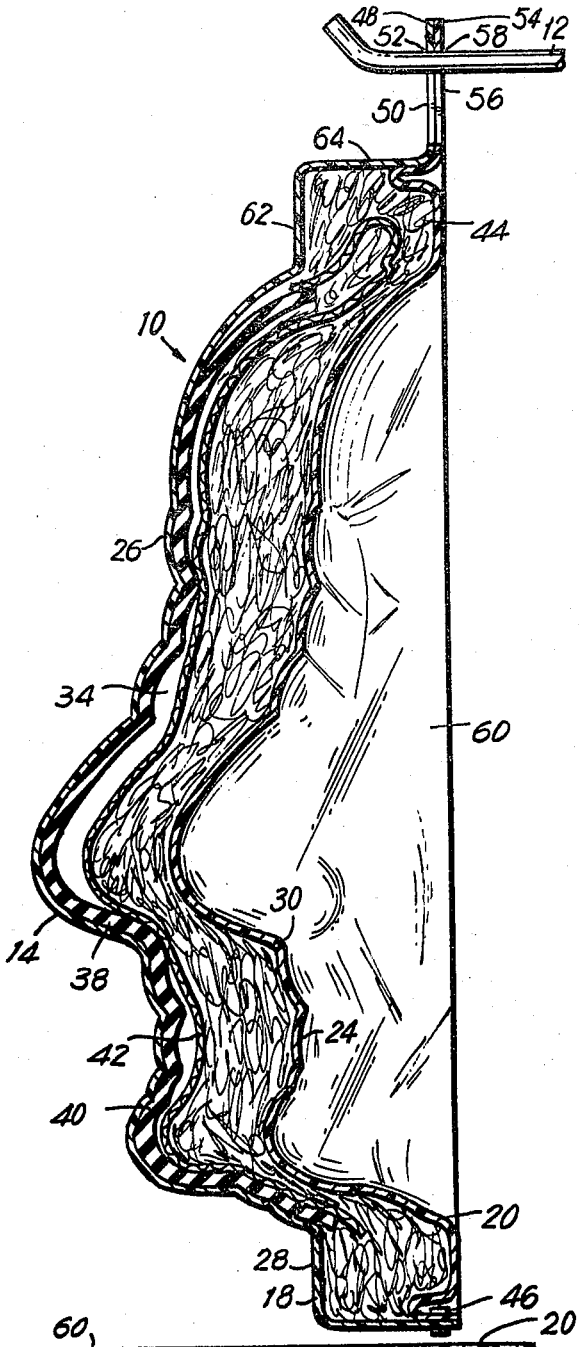
FIG. 2 is a vertical cross sectional view taken along lines 2—2 of FIG. 1, and shows the mask display package containing a mask and the artificial hair of the mask.
Figure 3:
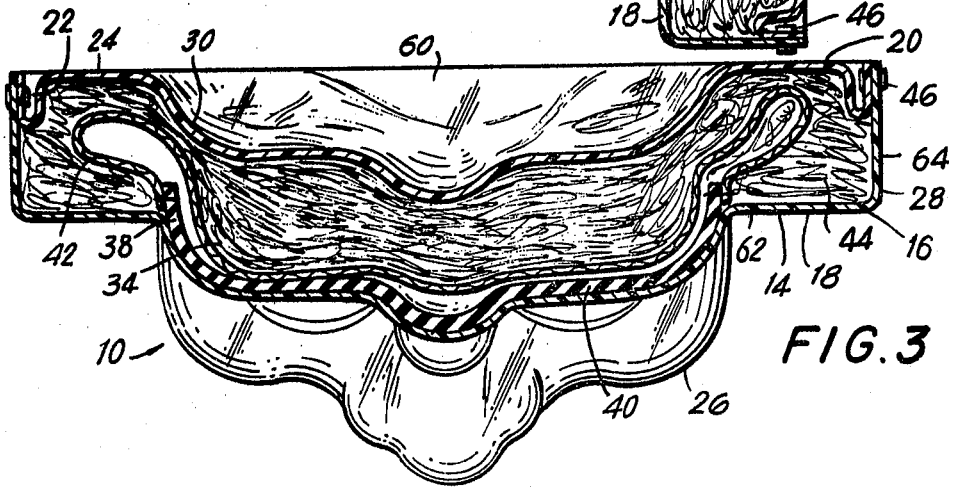
FIG. 3 is a horizontal cross sectional view taken along lines 3—3 of FIG. 1 and, again, shows the mask display package containing an over-the-head face mask with artificial hair.

The mask display package 10 basically comprises a front section 14 having an outer surface 16 (see FIG. 2). The front section 14 has an inner surface 18 (also best seen in FIG. 2). The mask display package 10 also includes a rear section 20 which, itself, has an inner surface 22 and an outer surface 24. When the mask display package 10 is assembled, with a mask 38 contained therein for display purposes, the front section 14 and the rear section 20 are secured to one another by staples 46 or other conventional fastening mechanisms.

Front section 14 has a centrally located, forwardly projecting three-dimensional, mask shaped area 26, which has the basic three-dimensional configuration of the mask 38, which the mask display package 10 is intended to house for shipping and display. Located peripherally with respect to the mask shaped area 26 of the front section 14 is a flat, yet also forwardly projecting and three-dimensional area 28. Three-dimensional area 28 has a flat surface 62 and an offset surface 64. The rear section 20 is provided with a centrally located, forwardly projecting three-dimensional mask shaped area 30, which also substantially corresponds to the three-dimensional configuration of the particular mask 38 sought to be housed in the mask display package 10. Surrounding the mask shaped area 30 of the rear section 20 is a flat, peripheral surface 32. When the front section 14 is assembled to the rear section 20, a mask holding pocket 34 (best seen in cross section in FIG. 2) is defined between the three-dimensional, forwardly projecting mask shaped area 26 of the front section 14 and the three-dimensional, mask shaped area 30 of rear section 20. The depth of offset surface 64 with respect to flat surface 62 defines the depth of mask holding pocket 34. It is in this holding pocket 34 that the mask 38 is housed during shipment and display. It should be appreciated that when the front section 14 and the rear section 20 are made from clear, i.e., transparent plastic, the coloration of the mask 38, housed in the mask holding pocket 34, shows through the three-dimensional mask shaped area 26 to provide an extremely realistic three-dimensional display of the mask 38.

Similarly, when the front section 14 and the rear section 20 are assembled together, a perimeter, artificial hair holding pocket 36 is formed between the flat, three-dimensional area 28 of the front section 14 and the flat peripheral surface 32 of rear section 20. This peripheral holding pocket 36 is intended to be used for maintaining during display the hair 44 of the mask 38. Here, again, the depth of offset surface 64 contributes to the determination of the depth of the peripheral holding pocket 36.

An over-the-head type mask 38, preferably manufactured from a rubber type composition, is intended to be sold by the mask display package 10. The mask basically comprises a three-dimensional, forwardly projecting, face portion 40 having, typically, a pair of eye holes, a nose, a mouth portion, etc. and a thin fabric-like backing 42. When the mask 38 is worn over the wearer's head, the backing 42 covers the back of the wearer's head to maintain the mask 38 in position. Generally, these masks 38 are provided with artificial hair 44 which extends about the top portion of the mask 38.

The front section 14 of the mask display package 10 is provided, at its top, with an upwardly extending supporting tab 48. The supporting tab 48 is provided with a slot 50 passing therethrough and a small, hemispherical recess 52, basically corresponding in shape and dimension to the cross section of cylinder display hook 12. Similarly, an upwardly extending supporting tab 54 (see FIG. 1, the rearmost package) of the rear section 20 is provided which, itself, has a slot 56 and a recess 58 identically shaped to recess 52. When the front section 14 and rear section 20 are assembled together, a carrying handle is provided for the mask display package 10 and, in addition, a slot having a recess is provided for facilitating the hanging of the mask display package on display hook 12.

As previously described, the mask display package 10 has a front section 14 with a central, forwardly projecting mask shaped area 26 and a rear section 20 with a forwardly projecting mask shaped area 30. Basically, these mask shaped areas 26 and 30 conform to the shape of the face portion 40 of the mask 38. Thus, a three-dimensional cavity 60 (see FIG. 2) is defined behind the rear section 20, i.e., behind the outer surface 24 of rear section 20. Three-dimensional cavity 60 is adapted to nestingly receive the forwardly projecting mask shaped area 26 of the front section 14 of a mask display package 10 located immediately behind a first mask display package 10.

A mask display package 10 is thus provided which realistically, in a three-dimensional manner, displays the face portion of a mask 38 at the point of sale. A transparent plastic is used for at least the mask shaped area 26 of the front section 14 so that the real colors of the mask 38 are revealed for display. In addition, the mask display package is extremely efficient in terms of conservation of space at the retailer's point of sale, since the mask display packages are easily nestable with one another. It should also be understood that the packages, by virtue of their nestability, are easily shipped and transported from the manufacturer to the retailer for ultimate sale.

The mask display package 10 of the present invention also allows a potential customer to remove a mask display package containing a mask 38 from the display hook 12 and place the package over the face of the potential customer, in order to try on the mask prior to purchase. This, indeed, is a significant advantage of the present invention and is facilitated by the existence of cavity 60 at the rear of the mask display package wherein the customer's face projects during trying on. The central mask shaped area 30 of the rear section 20 can also be made from a transparent plastic so that a potential purchaser, trying on the display package, with contained mask, can see through the eye slots of the mask and see himself in a mirror. Thus, at least the eye holes of the mask shaped area 30 of rear section 20 should be transparent. Furthermore, the purchaser of the mask 38, contained within the mask display package 10, is confident that the mask 38, itself, is relatively hygienic, i.e., germ-free since the mask 38 has not been tried on by others prior to purchase.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A mask display package, comprising:

(a) a three-dimensional, forwardly projecting face mask;

(b) a front package section having a centrally located forwardly projecting first mask area substantially corresponding, in three dimensions, to said face mask;

(c) a rear package section having a centrally located forwardly projecting second mask area substantially corresponding, in three dimensions, to said face mask;

(d) said first mask area being transparent;

(e) said first mask area and said second mask area, defining a relatively thin, hygienic, three-dimensional holding pocket for realistically displaying said face mask in three dimensions; and (f) the back of said second mask area of said rear package section being dimensioned to define a nesting cavity for accommodation of the front of said first mask area of said front package section of a second mask display package.

2. A mask display package, as claimed in claim 1, wherein:

(a) said face mask has a first set of eye slits; and (b) said second mask area has a set of transparent eye slits.

3. A mask display package as claimed in claim 1, wherein:

(a) said front section further comprises a forwardly projecting perimeter area surrounding at least a portion of said first mask shaped area; and (b) a corresponding portion of said rear section and said perimeter area define a hair holding pocket.

* * * * *